US006856774B2

(12) United States Patent
Sampe et al.

(10) Patent No.: US 6,856,774 B2
(45) Date of Patent: Feb. 15, 2005

(54) DEVELOPING DEVICE INCLUDING MAGNETIC MEMBER PROVIDED ON TONER-SCATTERING RESTRAINING DEVICE AND IMAGE FORMING APPARATUS INCLUDING THE DEVELOPING DEVICE

(75) Inventors: Atsushi Sampe, Yokohama (JP); Takeyoshi Sekine, Tokyo (JP); Masayuki Yamane, Kawasaki (JP); Tokuya Ohjimi, Kawasaki (JP); Junichi Sano, Yokosuka (JP); Toshio Koike, Kawasaki (JP); Fumihiro Sasaki, Fuji (JP); Hiroto Higuchi, Numazu (JP); Maiko Kondo, Numazu (JP); Kunihiro Ohyama, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 9 days.

(21) Appl. No.: 10/303,910

(22) Filed: Nov. 26, 2002

(65) Prior Publication Data

US 2003/0099481 A1 May 29, 2003

(30) Foreign Application Priority Data

Nov. 27, 2001 (JP) ..... 2001-361535

(51) Int. Cl.[7] ..... G03G 15/09
(52) U.S. Cl. ..... 399/104; 399/273; 399/277
(58) Field of Search ..... 399/267, 273, 399/275, 277, 103, 104

(56) References Cited

U.S. PATENT DOCUMENTS

| | | | | |
|---|---|---|---|---|
| 4,465,359 A | * | 8/1984 | Nakahata | 399/275 X |
| 4,686,935 A | * | 8/1987 | Matsui et al. | 399/277 X |
| 6,266,507 B1 | * | 7/2001 | Nagahama et al. | 399/267 X |
| 6,317,576 B1 | * | 11/2001 | Ishida et al. | 399/273 |
| 6,335,137 B1 | | 1/2002 | Suzuki et al. | 430/110.1 |
| 6,336,013 B1 | * | 1/2002 | Suda et al. | 399/104 X |
| 6,337,957 B1 | | 1/2002 | Tamaki et al. | 399/29 |
| 6,403,275 B1 | | 6/2002 | Kuramoto et al. | 430/111.4 |
| 6,442,364 B2 | | 8/2002 | Kai et al. | 399/277 |
| 6,468,706 B2 | | 10/2002 | Matsuda et al. | 430/108.6 |

FOREIGN PATENT DOCUMENTS

| | | |
|---|---|---|
| JP | 5-34665 | 5/1993 |
| JP | 08-015975 | 1/1996 |
| JP | 2000-305360 | 11/2000 |
| JP | 2001-263334 | 9/2001 |
| JP | 2002-072677 | 3/2002 |

OTHER PUBLICATIONS

U.S. Appl. No. 10/724,260, filed Dec. 1, 2003, inventor Emoto, et al.
U.S. Appl. No. 10/303,910, filed Nov. 26, 2002, inventor Sampe, et al.
U.S. Appl. No. 10/712,026, filed Nov. 14, 2003, inventor, Tomita et al.

* cited by examiner

*Primary Examiner*—William J. Royer
(74) *Attorney, Agent, or Firm*—Oblon, Spivak, McClelland, Maier & Neustadt, P.C.

(57) ABSTRACT

A developing device developing a latent image on a latent image carrier with a developer, and including a casing having an opening facing the latent image carrier and a developer carrier. Also included is a magnetic field generating device including a first magnetic pole generating a magnetic field causing the developer to rise on the developer carrier in a form of a magnet brush in a developing region, and a second magnetic pole generating a magnetic field at a downstream side of the first magnetic pole in a rotating direction of the developer carrier. Further, a toner-scattering restraining device is provided on an end portion of the casing at the downstream side of the developing region, and a magnetic member provided on a side of the toner-scattering restraining device facing the latent image carrier. A peak of a magnetic flux density set by the second magnetic pole in its normal direction is located outside of the opening.

15 Claims, 5 Drawing Sheets

DEVELOPING DEVICE INCLUDING MAGNETIC MEMBER PROVIDED ON TONER-SCATTERING RESTRAINING DEVICE AND IMAGE FORMING APPARATUS INCLUDING THE DEVELOPING DEVICE

CROSS-REFERENCE TO RELATED APPLICATIONS

The present application claims priority to Japanese Patent Application No. 2001-361535 filed in the Japanese Patent Office on Nov. 27, 2001, the disclosure of which is incorporated herein by reference.

BACKGROUND OF THE INVENTION

1. Field of the Invention

The present invention relates to a developing device and an image forming apparatus including the developing device such as a copying machine, a printer, a facsimile machine, or other similar image forming apparatus, and more particularly to a developing device using a two-component developer including toner and magnetic particles.

2. Discussion of the Background

In an electrophotographic image forming apparatus such as a copying machine, a printer, a facsimile machine, or other similar image forming apparatus, an electrostatic latent image formed on a latent image carrier is developed with a two-component developer (hereafter referred to as a "developer") including toner and magnetic particles (hereafter referred to as "magnetic carrier") and is formed into a toner image.

For example, a developing device using a two-component developer generally includes a casing that accommodates the developer and has an opening facing a latent image carrier, a non-magnetic developer carrier rotatably disposed such that a part of the developer carrier is exposed to the outside through the opening of the casing, and a magnetic field generating device disposed in the developer carrier. The developer accommodated in the casing is conveyed to a developing region facing the latent image carrier by rotating the developer carrier. In the developing region, the magnetic field generating device causes the developer to rise on the developer carrier in a form of a magnet brush. The magnet brush rubs itself against a latent image formed on the latent image carrier, and thereby toner is supplied from the magnet brush to the latent image on the latent image carrier.

In the above-described developing device using the two-component developer, a decrease in the distance between the latent image carrier and the developer carrier in the developing region allows a high image density to be easily obtained and reduces a so-called edge effect. However, when the latent image carrier and the developer carrier are close to each other, the image deterioration such as a so-called "omission of a trailing edge" in which a trailing edge portion of a black solid image or a halftone solid image is omitted, tends to occur.

Hereinafter described is a mechanism presumably causing the omission of the trailing edge of a toner image. The mechanism will be described referring to a developing device employing a so-called negative-to-positive developing method using a two-component developer, for example. In this developing device, magnetic carrier in a developer is positively charged, and toner in the developer is negatively charged. Further, a non-latent image portion on a latent image carrier is negatively charged.

In a developing region in the developing device, a magnet brush carried on a developer carrier approaching the latent image carrier continuously faces the non-latent image portion until the magnet brush arrives at a trailing edge of a latent image portion to be developed. During the movement of the magnet brush, a repulsive force generated between the negative charges of the non-latent image portion and the toner causes the toner to move toward the surface of the developer carrier away from the latent image carrier. Hereafter, this movement of the toner will be referred to as "toner drift." As a result, when the magnet brush arrives at the trailing edge of the latent image portion, the positively charged magnetic carrier in the magnet brush adjacent to the latent image carrier is exposed to the outside. In this condition, no toner is present on the surface of the magnetic carrier that faces the trailing edge of the latent image portion, and therefore, no toner is transferred from the magnet brush to the latent image carrier at the trailing edge of the latent image portion.

Further, when the magnet brush reaches a position slightly inward of the trailing edge of the latent image portion, and when an adhesion force acting between the toner and the latent image carrier is weak, the toner once adhered to the latent image portion on the latent image carrier may be returned to the magnetic carrier in a tip end portion of the magnet brush due to an electrostatic force. Consequently, the trailing edge portion of the latent image portion adjacent to the non-latent image portion may not be developed, thereby causing the omission of the trailing edge.

To prevent the occurrence of the omission of the trailing edge, a developing device in which a magnetic flux density distribution on a developer carrier in a direction normal to the surface of the developer carrier is limited has been proposed (for example, in the published Japanese patent application 2000-305360, and Japanese patent application No. 2001-007510 <Published application No. US2002/0094216>). The limited magnetic flux density distribution reduces the width of a developing region, or nip width, in the direction of rotation of the developer carrier.

In this developing device in which the width of the developing region in the direction of movement of the surface of the developer carrier is reduced, a time for a magnet brush to rub itself against a latent image carrier decreases, thereby restraining the above-described toner drift in which toner moves from the tip end portion of the magnet brush toward the surface of the developer carrier. Thus, toner is present on the surface of magnetic carrier that faces a trailing edge of a latent image portion, and magnetic carrier in the tip end portion of the magnet brush adjacent to the latent image carrier is not exposed to the outside. Therefore, the toner once adhered to the latent image portion on the latent image carrier does not return to the magnetic carrier in the tip end portion of the magnet brush. As a result, the omission of the trailing edge can be prevented.

On the other hand, there has been a problem of toner scattering occurring in a developer collecting section in a developing device to which the developer carried on the developer carrier is returned. Recently, to obtain a fine and high-resolution image, a small-particulate developer including small-particulate carrier and toner has been widely used. However, as the diameter of the developer is smaller, toner scattering tends to occur.

Specifically, the above-described toner scattering is a phenomenon in which floating toner in a developing device spouts out from a gap between the developer carried on a developer carrier and a tip end portion of a casing of the developing device at the downstream side of a developing region with respect to the direction of rotation of the developer carrier. In a developing device using a two-component developer, the toner scattering tends to occur in the following conditions. That is, a condition in which magnetic carrier carried on the developer carrier is uneven and a large amount of floating toner not sufficiently charged exists, when the magnetic carrier is mixed with non-charged toner at the time of initial setup. In addition, a condition in which a large amount of floating toner not sufficiently charged exists immediately after fresh toner is supplied to a developing device.

To restrain the toner scattering, a toner-scattering restraining sheet-shaped member made of polyethylene terephthalate (PET) is used. The toner-scattering restraining sheet-shaped member is provided on an end portion of a casing of a developing device such that a free end of the toner-scattering restraining sheet-shaped member adjoins a developer carrier to reduce a gap between the casing at a developer collecting section in the developing device and a developer carried on the developer carrier. In the developing device using a two-component developer, the free end of the toner-scattering restraining sheet-shaped member is disposed in a non-contact relation to the developer on the developer carrier so as to prevent the toner-scattering restraining sheet-shaped member from scraping the developer off the developer carrier and prevent the falling of the developer.

FIG. 1 illustrates a developing device in which the width of a developing region, or nip width, in the direction of rotation of a developer carrier is reduced. Specifically, a part of a developing sleeve 4 serving as a developer carrier is exposed to the outside through an opening of a casing 2*a* facing a photoconductive drum 1 serving as a latent image carrier. A main pole P1 (N pole) for development is formed on a magnet roller 5 in the developing sleeve 4 to cause a developer to rise in the form of magnetic brush at the position facing a developing region (D) formed between the developing sleeve 4 and the photoconductive drum 1.

Further, auxiliary poles P1*a* (S pole) and P1*b* (S pole) each having a polarity opposite to that of the main pole P1 adjoin the main pole P1 at the upstream side and downstream side, respectively, in the direction of rotation of the developing sleeve 4. The auxiliary poles P1*a* and P1*b* reduce the angular half-width of a magnetic flux density distribution set up by the main pole P1 in the direction normal to the developing sleeve 4. A pole P4 (N pole) is located between a position facing a doctor blade 7*a* and the developing region (D) such that its magnetic field extends to a developer storing section (S). Further, a pole P2 (N pole) and a pole P3 (S pole) are so positioned as to convey the developer carried on the developing sleeve 4. In FIG. 1, dotted curves around the developing sleeve 4 represent magnetic flux density distributions formed by the poles in the direction normal to the surface of the developing sleeve 4, as measured at the center of the developing sleeve 4 in the axial direction.

As described above, by forming the auxiliary pole P1*b* adjoining the main pole P1 on the magnet roller 5 to reduce the angular half-width of a magnetic flux density distribution set up by the main pole P1 in the direction normal to the developing sleeve 4, a side of the magnetic flux density distribution formed by the auxiliary pole P1*b* in the direction normal to the surface of the developing sleeve 4 and close to the main pole P1 is located outside of the opening of the casing 2*a*. Further, as the size of the developing sleeve 4 reduces, the distance on the developing sleeve 4 between the main pole P1 and the auxiliary pole P1*b* decreases. As a result, the peak of the magnetic flux density set by the auxiliary pole P1*b* in its normal direction is located outside of the opening of the casing 2*a* as well.

In the above-described developing device in which the peak of the magnetic flux density set by the auxiliary pole P1*b* in its normal direction is located outside of the opening of the casing 2*a* and the width of the pole P1*b* is small, a sufficient magnetic force cannot be obtained, and the centrifugal force exerted on the magnetic carrier carried on the developing sleeve 4 by the rotation of the developing sleeve 4 exceeds the magnetic force. As a result, the magnetic carrier may be free of the developing sleeve 4 and scatter. When the magnetic carrier scatters from the part of the developing sleeve 4 exposed to the outside, the magnetic carrier may contaminate the inside of the apparatus. Further, when the magnetic carrier falls on a sheet conveying guide or a transfer sheet, so-called "white spot" occurs. The "white spot" means a condition in which a toner image is partially omitted at around magnetic carrier on a transferred toner image on a transfer sheet. Thus, an image is deteriorated.

Referring to FIG. 6, when a toner-scattering restraining sheet-shaped member 13 is provided on an end portion of the casing 2*a* of the above-described developing device of FIG. 1 such that its free end adjoins the developing sleeve 4, to reduce a gap between the casing 2*a* at a developer collecting section in the developing device and a developer carried on the developing sleeve 4, the magnetic carrier scattering from the part of the developing sleeve 4 exposed to the outside falls onto the surface of the toner-scattering restraining sheet-shaped member 13 facing the photoconductive drum 1, and is captured on the toner-scattering restraining sheet-shaped member 13.

Further, in an image forming apparatus, vibrations occur, for example, when a developing device is driven and when a transfer sheet is conveyed. When the magnetic carrier deposited on the toner-scattering restraining sheet-shaped member 13 receives such vibrations, the magnetic carrier may fall from the toner-scattering restraining sheet-shaped member 13. In a developing device which lacks a toner-scattering restraining sheet-shaped member 13, magnetic carrier scattering from a part of a developing sleeve exposed to the outside, specifically the magnetic carrier falling onto a surface of an inner wall of a casing, is returned to the inside of the developing device by the rotation of the developing sleeve. In this condition, if the toner-scattering restraining sheet-shaped member 13 is provided, occurrence of carrier falling increases.

SUMMARY OF THE INVENTION

According to an aspect of the present invention, a developing device for developing a latent image formed on a latent image carrier with a developer includes a casing configured to accommodate the developer including toner and magnetic particles. The casing includes an opening facing the latent image carrier. The developing device further includes a non-magnetic developer carrier configured to rotate and carry the developer to a developing region where the developer carrier faces the latent image carrier, and is disposed such that a part of the developer carrier is exposed to the outside through the opening of the casing. Also included is a magnetic field generating device disposed in the developer carrier to generate magnetic fields. The magnetic field generating device includes a first magnetic pole generating a magnetic field that causes the developer to rise on the developer carrier in a form of a magnet brush in the developing region, and a second magnetic pole generating a magnetic field at a downstream side of the first magnetic pole in a direction of rotation of the developer carrier. The developing device further includes a toner-scattering restraining device provided on an end portion of the casing at a downstream side of the developing region in the direction of rotation of the developer carrier such that the toner-scattering restraining device faces the latent image carrier and reduces a gap between the developer carried on the developer carrier and the end portion of the casing, so as to restrain the toner from scattering from the gap. A magnetic member is also provided on a side of the toner-scattering restraining device facing the latent image carrier. A peak of a magnetic flux density set by the second magnetic pole in its normal direction is located at a position outside of the opening of the casing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
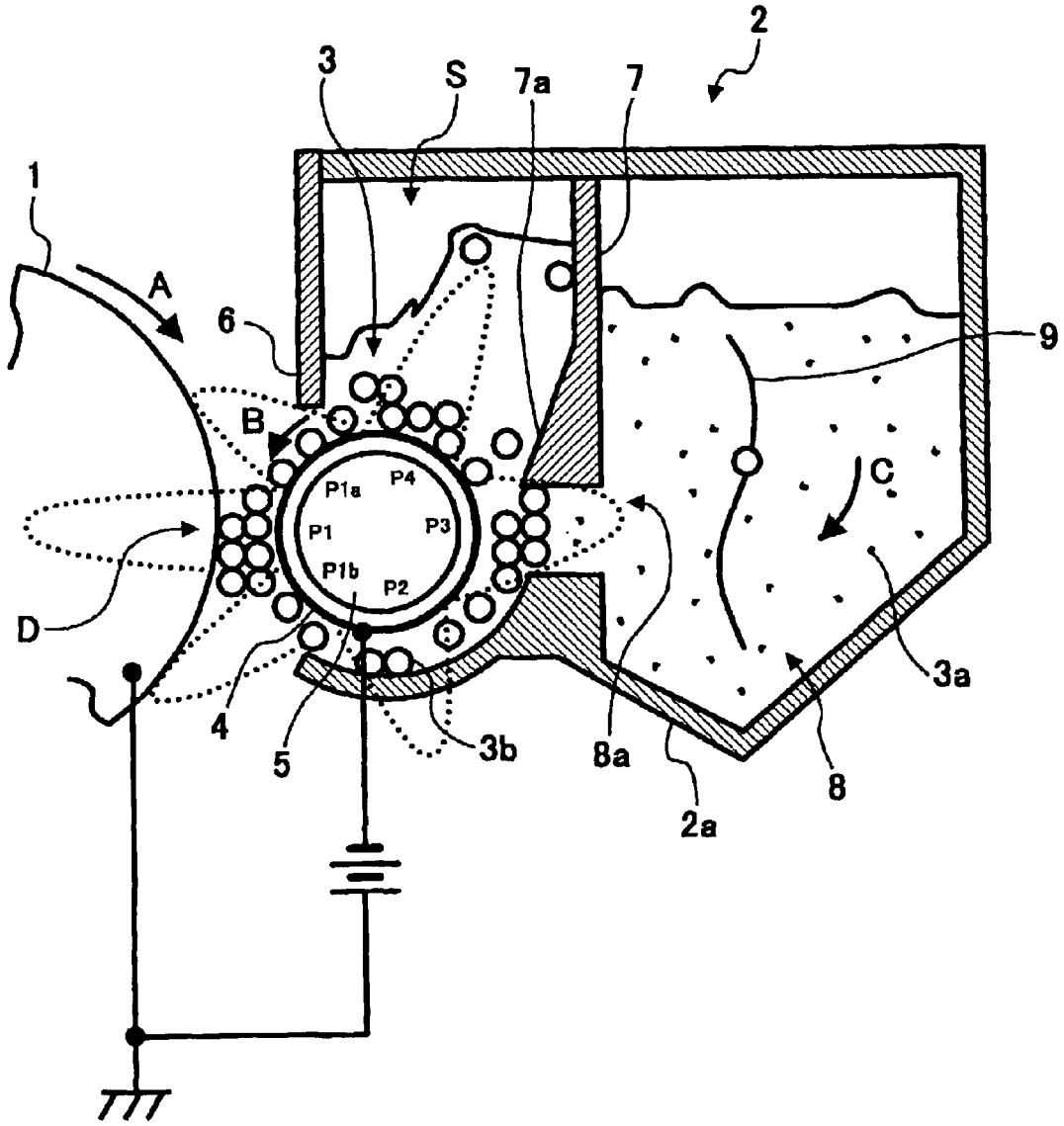
FIG. 1 is a schematic view of a developing device according to one embodiment of the present invention.

Preferred embodiments of the present invention are described in detail referring to the drawings, wherein like reference numerals designate identical or corresponding parts throughout the several views.

Figure 2:
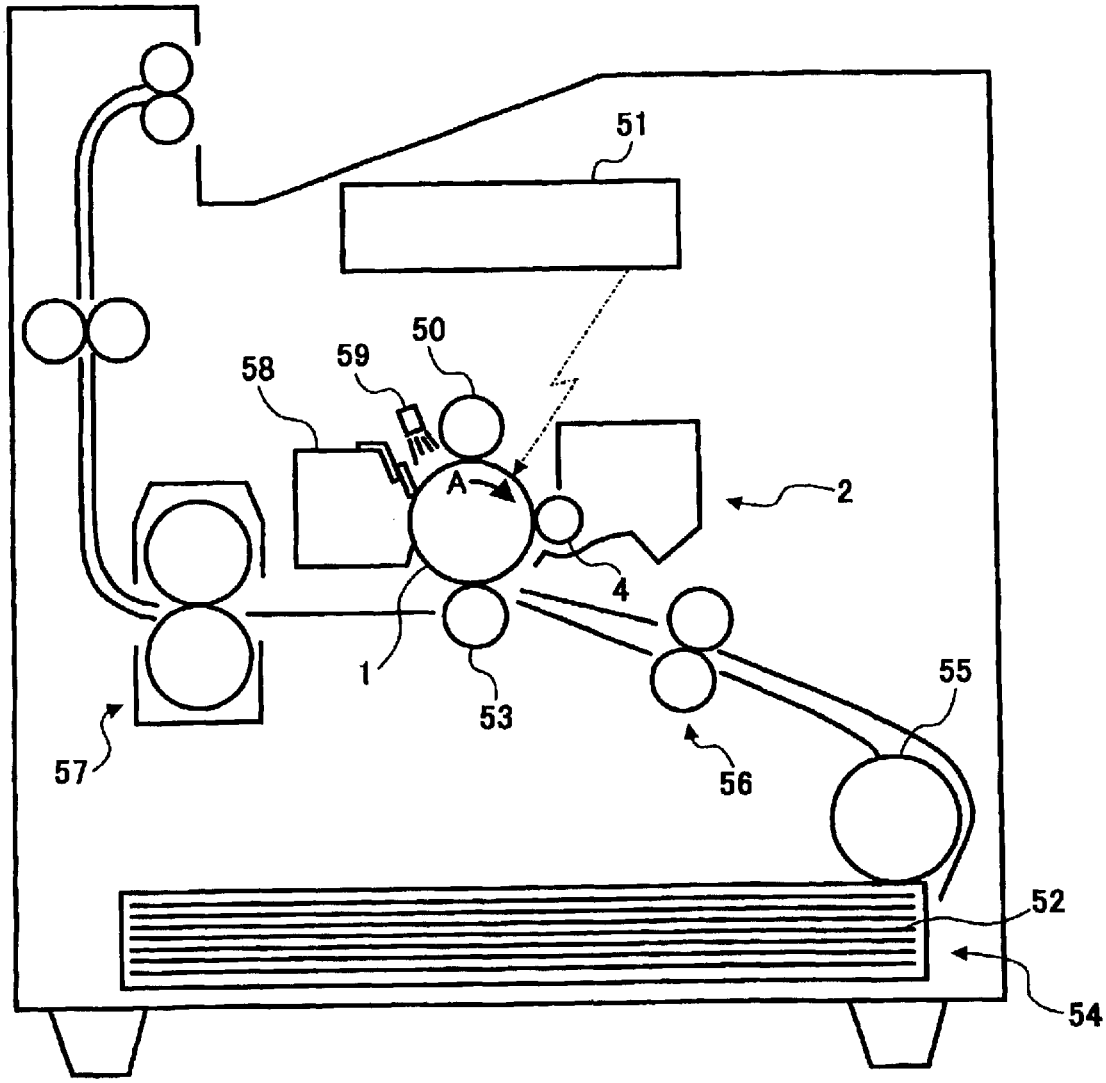
FIG. 2 is a schematic view of a laser printer including the developing device of FIG. 1.

A developing device in a laser printer (hereafter referred to as a "printer") as an example of an electrophotographic image forming apparatus to which the present invention is applied will now be described. FIG. 2 is a schematic view of the printer including the developing device according to one embodiment of the present invention. Referring to FIG. 2, the printer includes a photoconductive drum 1 serving as a latent image carrier. While the photoconductive drum 1 is driven to rotate in a direction indicated by an arrow A, a charging roller 50 uniformly charges the surface of the photoconductive drum 1 in contact with the photoconductive drum 1. Subsequently, an optical writing unit 51 scans the charged surface of the photoconductive drum 1 in accordance with image data, thereby forming a latent image on the surface of the photoconductive drum 1. While the charging roller 50 and the optical writing unit 51 constitute a latent image forming device in this embodiment, any other charging device and any other exposing device may be used.

A developing device 2 develops the latent image with a developer and forms a toner image on the photoconductive drum 1. A sheet 52 as a transfer material is fed from a sheet feeding cassette 54 to a pair of registration rollers 56 by a sheet feeding roller 55. The registration roller pair 56 conveys the sheet 52 to an image transfer device including an image transfer roller 53 at an appropriate timing. The image transfer device transfers the toner image from the photoconductive drum 1 to the sheet 52. The transferred toner image on the sheet 52 is fixed thereonto in a fixing device 57. Thereafter, the sheet 52 with the fixed toner image is discharged from the printer. A cleaning device 58 removes residual toner remaining on the photoconductive drum 1 after the toner image is transferred to the sheet 52. Further, a discharge lamp 59 discharges the surface of the photoconductive drum 1.

Next, the construction of the developing device 2 will be described referring to FIG. 1, which is a schematic view of the developing device 2. As illustrated in FIG. 1, the developing device 2 is arranged at a side of the photoconductive drum 1. The developing device 2 includes a non-magnetic developing sleeve 4 serving as a developer carrier that carries a two-component developer 3 (hereafter referred to as a developer) including magnetic toner 3*a* and magnetic carrier 3*b* on the surface of the developing sleeve 4. The developing sleeve 4 is partly exposed to the outside through an opening formed in a casing 2*a* at a side of the photoconductive drum 1. A drive device (not shown) drives the developing sleeve 4 to rotate in a direction indicated by an arrow B, thereby conveying the developer 3 downward (i.e., in the direction B) in a developing region (D) formed between the photoconductive drum 1 and the developing device 4. A magnet roller 5 serving as a magnetic field generating device is disposed in the developing sleeve 4 and implemented by a group of stationary magnets.

The developing device 2 further includes a first doctor blade 6 serving as a first developer regulating member that regulates the amount of the developer 3 being conveyed by the developing sleeve 4 toward the developing region (D), and a developer case 7 that forms a developer storing section (S) between the developing sleeve 4 and the first doctor blade 6 at a position upstream of the first doctor blade 6 with respect to a direction in which the developing sleeve 4 conveys the developer 3. The developing device 2 further includes a toner hopper 8 serving as a toner storing section which stores fresh toner 3*a* therein. The toner hopper 8 includes a toner supply opening 8*a* directed toward the developing sleeve 4 and adjoining the upstream side of the developer storing section (S) in the direction in which the developing sleeve 4 conveys the developer 3. In the toner hopper 8, an agitator 9 serving as a toner agitating member is disposed and rotated by a driving device (not shown) in the clockwise direction indicated by an arrow C. The agitator 9 conveys the toner 3*a* in the toner hopper 8 toward the toner supply opening 8*a* while agitating the toner 3*a*. The agitator 9 is made of polyethylene terephthalate (PET) and has a thickness of about 0.05 mm.

The developer case 7 has a penthouse-like leading edge portion adjoining the developing sleeve 4. This leading edge portion is used as a second doctor blade 7*a* serving as a second developer regulating member that regulates the amount of the toner 3*a* supplied into the developer storing section (S). Further, a part of the developer 3 obstructed by the first doctor blade 6 is returned to the developer storing section (S).

The magnets of the magnet roller 5 form radially outwardly extending magnetic poles positioned one after another around the axis of the magnet roller 5. Specifically, a main pole P1 (N pole) for development causes the developer 3 to rise in the form of magnet brush at the position facing the developing region (D). Auxiliary poles P1*a* (S pole) and P1*b* (S pole) each having polarity opposite to that of the main pole P1 adjoin the main pole P1 at the upstream side and downstream side, respectively, in the direction of rotation of the developing sleeve 4.

The auxiliary poles P1*a* and P1*b* reduce the angular half-width of a magnetic flux density distribution set up by the main pole P1 in the direction normal to the developing sleeve 4. A pole P4 (N pole) is located between a position facing the second doctor blade 7*a* and the developing region (D) such that the magnetic force of the magnetic field is exerted on the developer storing section (S). Further, a pole P2 (N pole) and a pole P3 (S pole) are so positioned as to convey the developer 3 carried on the developing sleeve 4 as in the conventional developing device. In this embodiment, an angle formed between the pole P1 (N pole) and the pole P1*b* (S pole) is from 30° to 45°.

In FIG. 1, dotted curves around the developing sleeve 4 represent magnetic flux density distributions formed by the poles in the direction normal to the surface of the developing sleeve 4, as measured at the center of the developing sleeve 4 in the axial direction. As illustrated in FIG. 1, the peak of the magnetic flux density set by the auxiliary pole P1*b* in its normal direction is located at a position outside of the opening of the casing 2*a*. Although the magnet roller 5 has six poles in this embodiment, additional poles may be arranged between the auxiliary poles P1*b* and P1*a*. For example, the magnet roller 5 may have eight or ten poles.

The magnet forming the main pole P1 has a small cross-sectional area in a plane perpendicular to the axis of the magnet roller 5. Generally, a magnetic force decreases with a decrease in the cross-sectional area of a magnet. If the magnetic force on the sleeve surface is excessively weak, it is likely that the force of holding the magnetic carrier is too weak to prevent the magnetic carrier from adhering to the photoconductive drum 1. In view of this, in this embodiment, the magnet for the main pole P1 is formed from a rare earth metal alloy magnet that exerts a strong magnetic force.

Representative examples of a rare earth metal alloy magnet include an iron neodymium boron alloy magnet having a maximum energy product of about 358 kJ/m$^3$, and an iron neodymium boron alloy bond magnet having a maximum energy product of about 80 kJ/m$^3$. By using these magnets, the necessary surface magnetic force of the developing sleeve 4 can be ensured, even if the magnet having a small cross-sectional area is used. As examples of a magnet used in a conventional developing device, a ferrite magnet and a ferrite bond magnet have maximum energy products of about 36 kJ/m$^3$ and 20 kJ/m$^3$, respectively. A samarium-cobalt metal alloy magnet is another magnet that can ensure the above magnetic force.

The operation of the developing device 2 will be described referring to FIG. 1. The developer 3 on the developing sleeve 4 is conveyed in the direction "B" by the rotation of the developing sleeve 4, and the thickness of the developer 3 on the developing sleeve 4 is regulated by the first doctor blade 6 to be decreased. The developing sleeve 4 conveys the regulated developer 3 to the developing region (D). At the developing region (D), the toner 3*a* is transferred from the developing sleeve 4 to the latent image formed on the photoconductive drum 1 to develop the latent image. The developing sleeve 4 further conveys the developer 3 having passed through the developing region (D) to a position facing the toner supply opening 8*a* of the toner hopper 8.

Fresh magnetic toner 3*a* fed out by the agitator 9 is staying in the toner supply opening 8*a* in the condition that the magnetic toner 3*a* contacts the developer 3 on the developing sleeve 4. After the developer 3 has taken in the fresh toner 3*a*, the developing sleeve 4 returns the developer 3 to the developer storing section (S). The developer 3 containing such fresh toner 3*a* has its internal pressure increased by the first doctor blade 6. In this condition, the toner 3*a* and carrier 3*b* rub against each other in the developer 3, and thereby the toner 3*a* is charged by friction. On the other hand, the developer 3 obstructed by the first doctor blade 6 is circulated in the developer storing section (S).

In the developing device 2, an automatic toner density control is performed. Specifically, the condition in which the second doctor blade 7*a* regulates the developer 3 conveyed by the developing sleeve 4 varies according to the toner density in the developer 3 on the developing sleeve 4. The toner density in the developer 3 having released the toner 3*a* for development is automatically controlled to a predetermined range. With the automatic toner density control, the toner density in the developer 3 on the developing sleeve 4 is maintained to be in a range of substantially constant toner density.

Next, a description will made of the developer 3 used in the developing device 2. The developing device 2 performs the automatic toner density control that causes toner density to vary over a relatively broad range. In this respect, to avoid toner scattering when the toner density becomes high, it is desirable to use magnetic toner containing a binder resin and a magnetic particle and having the following property.

The magnetic toner preferably contains 40 to 80 No. % of toner particles having a weight average particle diameter of 6.0 to 8.0 $\mu$m and a diameter of 5 $\mu$m or less. Further, it is preferable that an amount of fluidity imparting agent mixed in the magnetic toner is 0.1 to 2 mass percent relative to the magnetic toner. When the amount of fluidity imparting agent mixed in the magnetic toner is less than 0.1 mass percent, the effect of improving toner agglutination may reduce, and when the amount exceeds 2 mass percent, problems such as toner scattering between fine lines, contamination of the interior of the apparatus, damage and abrasion of the photoconductive drum may tend to occur.

The core material of the magnetic carrier in the developer may be formed of any conventional materials such as iron, cobalt, nickel or similar ferromagnetic metal, magnetite, hematite, ferrite or similar alloy or compound, or a combination of the ferromagnetic metal and resin. The magnetic carrier is preferably coated with resin for enhancing durability. The average diameter of the magnetic carrier is preferably 20 to 80 $\mu$m.

Figure 3:
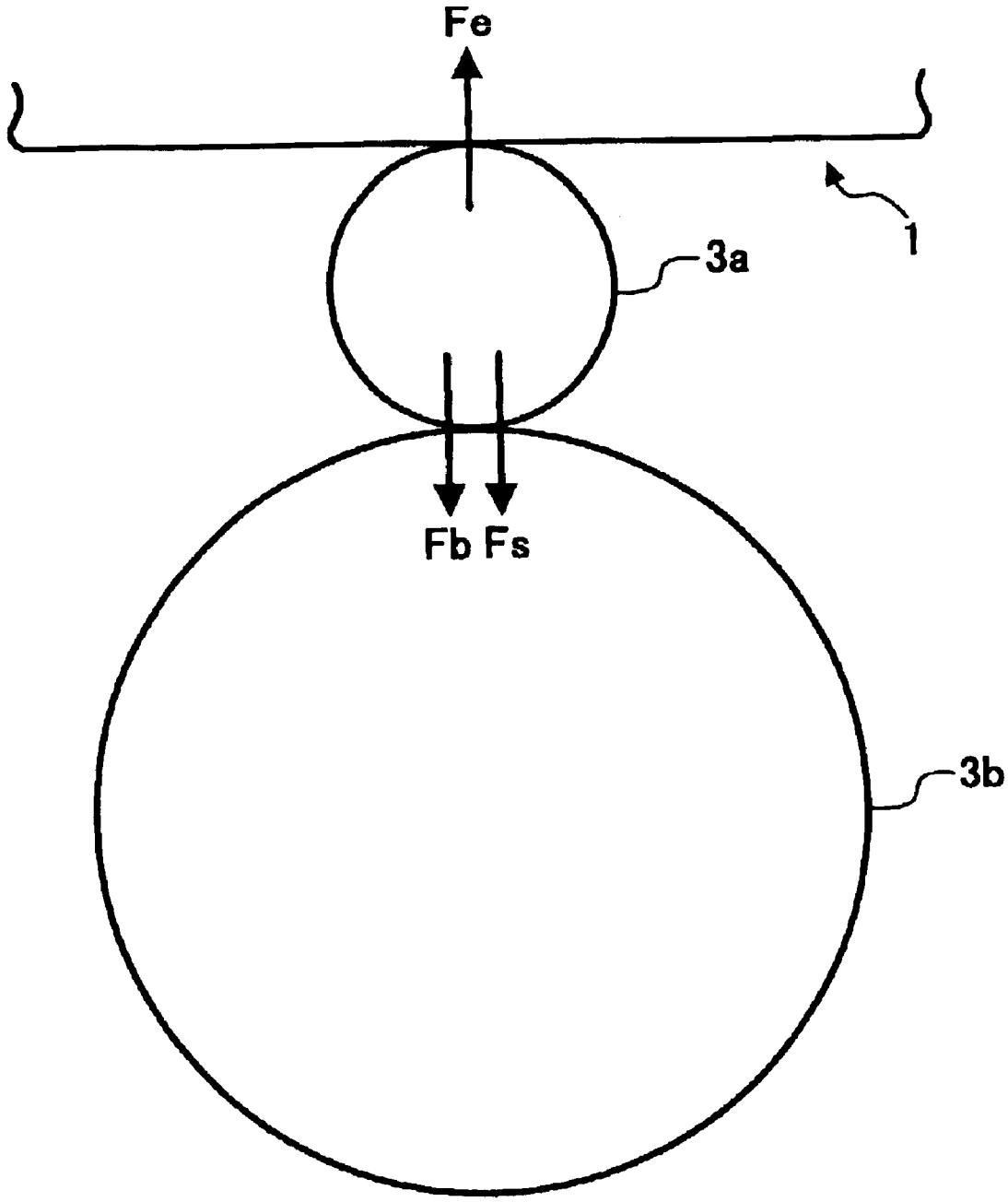
FIG. 3 is a schematic view for explaining a force exerted on toner in a tip end portion of a magnet brush.

Next, a description will be made of forces exerted on the magnetic toner 3*a* in the developing region (D). As illustrated in FIG. 3, a force (Fe) derived from the electric field exerted on the toner 3*a* between the toner 3*a* and the photoconductive drum 1 is indicated by an arrow (Fe). Further, an electrostatic force (Fs) exerted between the toner 3*a* and the carrier 3*b* is indicated by an arrow (Fs). Moreover, a magnetic force (Fb) attracting the toner 3*a* toward the developing sleeve 4 and exerted on the toner 3*a* is indicated by an arrow (Fb). The force derived from the above-described toner drift may be considered to be the increment ($\alpha$) of the electrostatic force (Fs). Specifically, when the toner drift occurs, the sum of (Fs) and ($\alpha$) acts on the toner 3*a* and tends to return the toner 3*a* toward the carrier 3*b*.

In light of the above, in this embodiment, the magnetic flux density set up by the main pole (P1) in the direction normal to the surface of the developing sleeve 4 is provided with a peak value whose attenuation ratio is 50% or greater. This reduces the nip width for development, i.e., the width of the developing region (D) in the direction of movement of the sleeve surface. Such a nip width successfully reduces the increment ($\alpha$) of the electrostatic force (Fs) to zero or reduces it to a noticeable degree. Further, the developer 3 forms a dense magnet brush in the developing region (D). Moreover, it was experimentally found that the magnet brush had a uniform height over the entire axial direction of the developing sleeve 4. As a result, a solid image without its trailing edge being omitted can be formed, and therefore image quality can be improved despite the use of the magnetic toner.

Figure 4:
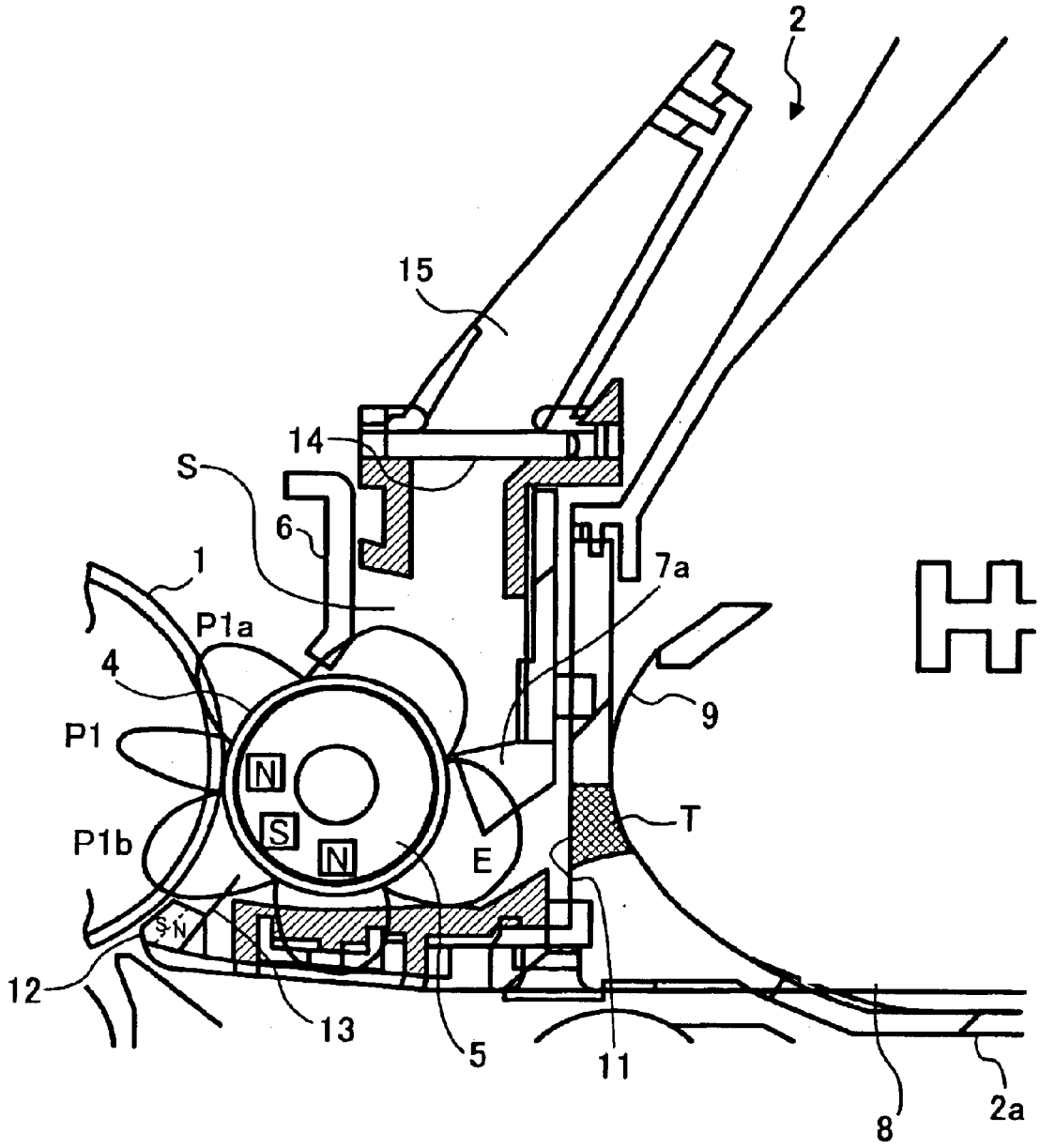
FIG. 4 is a schematic view of a developing device including a toner-scattering restraining sheet-shaped member according to the embodiment of the present invention.

Next, a toner-scattering restraining device in the developing device 2 according to the present embodiment will be described. FIG. 4 is a schematic view of a developing device including a toner-scattering restraining device. Referring to FIG. 4, the developing device 2 includes a toner-scattering restraining sheet-shaped member 13 serving as a toner-scattering restraining device at the tip end portion of the casing 2*a* at a downstream side of the developing region (D) in the direction of conveyance of the developer 3. The toner-scattering restraining sheet-shaped member 13 faces the photoconductive drum 1. In this embodiment, the toner-scattering restraining sheet-shaped member 13 is made of polyethylene terephthalate (PET) and has a thickness of about 0.05 mm. The toner-scattering restraining sheet-shaped member 13 is disposed at an angle of from 40° to 50° with respect to the tip end portion of the casing 2*a* and protrudes by about 4 mm. The gap formed between the leading edge of the toner-scattering restraining sheet-shaped member 13 and the surface of the developing sleeve 4 is from 1 mm to 2.5 mm.

The developing device 2 further includes a magnet sheet 12 on the side of the toner-scattering restraining sheet-shaped member 13 facing the photoconductive drum 1. A distance between the surface (S pole) of the magnet sheet 12 and the photoconductive drum 1 is from about 0.3 mm to 2 mm. The magnet sheet 12 has a length of about 310 mm, a width of about 2.5 mm, and a thickness of about 1 mm. The magnet sheet 12 is formed from a rubber magnet, for example, N-1400 manufactured by Sumitomo 3M having a magnetic force of from 30 to 50 mT. One side of the magnet sheet 12 facing the photoconductive drum 1 is magnetized to a polarity equal to the polarity of the pole P1*b* (S pole) of the magnet roller 5. The other side of the magnet sheet 12 in contact with the toner-scattering restraining sheet-shaped member 13 is magnetized to a polarity opposite to the polarity of the pole P1*b*.

In this embodiment, the toner-scattering restraining sheet-shaped member 13 is disposed substantially parallel to a normal direction connecting between the magnet sheet 12 and the rotation center of the developing sleeve 4. The toner-scattering restraining sheet-shaped member 13 is made of a transparent polyethylene terephthalate (PET). By using the PET, the gap between the photoconductive drum 1 and the developing sleeve 4 can be measured with a non-contact type laser measurement device in the inspection process. As an alternative to the toner-scattering restraining sheet-shaped member 13, the toner-scattering restraining device may be formed from a part of the casing 2*a* in the shape facing the photoconductive drum 1.

Hereinafter, described is toner scattering occurred in a developer collecting section in the developing device 2. In the developing device 2, an inching operation is performed at the time of initial setup. A heat seal 11 seals the toner 3*a* in the toner hopper 8. Further, a heat seal 14 seals the magnetic carrier 3*b* in a magnetic carrier storing chamber 15. When the developing device 2 is set up, the heat seals 11 and 14 are pulled out. The agitator 9 is in press-contact with the casing 2*a* at the side of the developing sleeve 4 by use of the resilient force of the agitator 9 so as to prevent the toner 3*a* from spouting out of the toner hopper 8 when the heat seal 11 is pulled out. However, even though the toner 3*a* is blocked by the agitator 9, the toner 3*a* may enter space (T) in FIG. 4 due to vibration, impact, and the like. Immediately after the heat seal 11 is pulled out, the toner 3*a* filled in the space (T) starts to flow toward the developing sleeve 4 and is temporarily captured on the surface of the developing sleeve 4 by the magnetic force of the magnet roller 5. When the amount of toner flown from the toner hopper 8 is relatively large, the toner-scattering restraining sheet-shaped member 13 blocks the toner 3*a* so as to prevent the toner 3*a* from scattering to the outside of the developing device 2.

The magnetic carrier 3*b* which has fallen from the magnetic carrier storing chamber 15 by gravity is temporarily trapped in a gap between the second doctor blade 7*a* and the developing sleeve 4 and stays in the developer storing section (S) without falling to space (E) located below the developer storing section (S). Therefore, only the toner 3*a* having entered the space (T) exists in the space (E).

When the developing sleeve 4 is rotated, the magnetic carrier 3*b* in the developer storing section (S) passes the first doctor blade 6, and mixes with the toner 3*a*. During tens of seconds after the developing sleeve 4 starts rotating, the toner 3*a* having entered the space (T) and fallen into the space (E) is mixed and agitated with the magnetic carrier 3*b*. At this time, floating toner captured by neither the developer 3 nor the developing sleeve 4 tends to blast out toward the photoconductive drum 1 by an airflow. The toner-scattering restraining sheet-shaped member 13 serves to obstruct the airflow or direct the airflow toward the developing sleeve 4, thereby restraining occurrence of toner scattering.

At the area where the developing sleeve 4 is exposed to the outside, especially when the magnetic carrier 3*b* floating at the pole P1*b* falls onto the surface of the toner-scattering restraining sheet-shaped member 13 facing the photoconductive drum 1, the magnetic carrier 3*b* is once captured by the magnet sheet 12 due to its magnetic force. Further, when vibrations are given to the magnetic carrier 3*b* deposited on the surface of the toner-scattering restraining sheet-shaped member 13 facing the photoconductive drum 1, the magnetic carrier 3*b* flies and is carried again by the developing sleeve 4 due to the magnetic field formed by the magnetic pole P1*b* of the magnet roller 5, and is returned to the inside of the developing device 2. Thus, the magnet sheet 12 serves to prevent the magnetic carrier 3*b* from falling from the toner-scattering restraining sheet-shaped member 13.

In this embodiment, because the toner-scattering restraining sheet-shaped member 13 is disposed substantially parallel to the normal direction connecting between the magnet sheet 12 and the rotation center of the developing sleeve 4, the magnetic carrier 3*b* captured by the magnet sheet 12 is effectively returned to the developing sleeve 4 by the magnetic force generated in the normal direction of the magnet roller 5.

Further, in this embodiment, one side of the magnet sheet 12 facing the photoconductive drum 1 is magnetized to the polarity equal to the polarity of the pole P1*b* (S pole) of the magnet roller 5. Therefore, the magnet sheet 12 can prevent the magnetic carrier 3*b* from falling, and cause the magnetic carrier 3*b* to easily return to the developing sleeve 4 as well.

Figure 5:
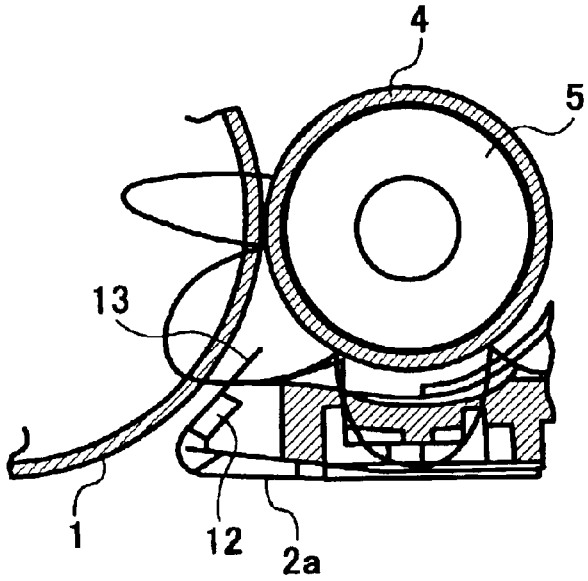
FIG. 5 is a schematic view of a developing device including a toner-scattering restraining sheet-shaped member according to a comparative example.
Figure 6:
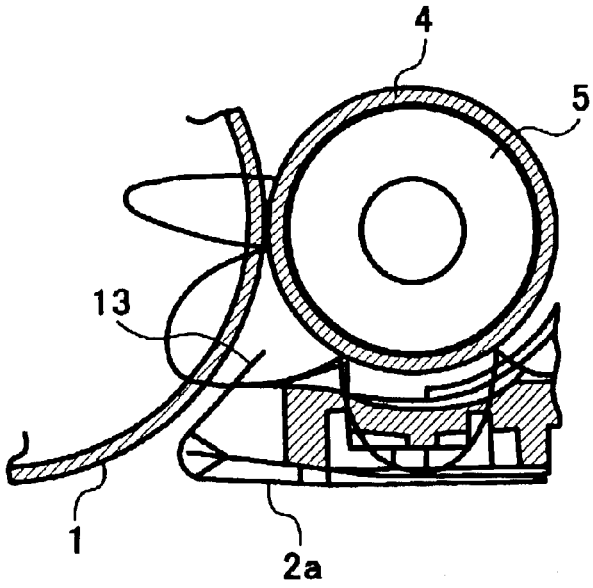
FIG. 6 is a schematic view of a background developing device including a toner-scattering restraining sheet-shaped member.

FIG. 5 is a schematic view of a developing device including a toner-scattering restraining sheet-shaped member 13 according to a comparative example. In this comparative example, the magnet sheet 12 is provided on the side of the toner-scattering restraining sheet-shaped member 13 opposite the photoconductive drum 1. In this case, the magnetic carrier floating in the area where the developing sleeve 4 is exposed to the outside can be captured on the surface of the toner-scattering restraining sheet-shaped member 13 facing the photoconductive drum 1 to some extent. However, the magnet sheet 12 does not catch the magnetic carrier and not cause the magnetic carrier to return to the developing sleeve 4. Therefore, as the magnetic carrier is deposited on the surface of the toner-scattering restraining sheet-shaped member 13 facing the photoconductive drum 1, the magnetic carrier may fall from the toner-scattering restraining sheet-shaped member 13 due to the vibrations which occur when a transfer sheet passes the developing device 2.

In the above-described developing device 2, with the provision of the toner-scattering restraining sheet-shaped member 13 at the tip end portion of the casing 2*a* at the downstream side of the developing region (D) in the direction of conveyance of the developer 3, and with the provision of the magnet sheet 12 on the side of the toner-scattering restraining sheet-shaped member 13 facing the photoconductive drum 1, even when a relatively large amount of magnetic carrier scatters in the area where the developing sleeve 4 is exposed to the outside, the carrier falling in addition to the toner scattering can be restrained.

As described above, in the developing device 2 in which the peak of the magnetic flux density set by the pole P1*b* in its normal direction is located at a position outside of the opening of the casing 2*a,* the carrier falling caused by the carrier scattering occurred at the area where the developing sleeve 4 is exposed to the outside and the toner scattering occurred at the developer collecting section can be restrained.

Further, in the above-described developing device 2 using the magnetic toner, the toner is attracted to the magnetic particle by the magnetic force. Therefore, the toner scattering can be restrained.

Further, with the provision of the above-described developing device 2 according to the embodiment of the present invention in the image forming apparatus, a stable high quality image can be obtained.

The present invention has been described with respect to the embodiments as illustrated in the figures. However, the present invention is not limited to the embodiment and may be practiced otherwise.

The present invention is shown applied to the developing device 2 in which the auxiliary pole P1*b* adjoining the main pole P1 generates a magnetic field at a downstream side of the main pole P1 in a direction of rotation of the developing sleeve 4, and the auxiliary pole P1*b* forms a magnetic force limiting a magnetic flux density distribution set up by the main pole P1 in its normal direction to obtain a high quality image and to reduce the nip width for development. However, the present invention is not limited to the above-described developing device 2 and may be applied to a developing device in which a peak of a magnetic flux density set by an auxiliary pole, which generates a magnetic field at a downstream side of a main pole in a direction of rotation of a developing sleeve, in its normal direction is located at a position outside of an opening of a casing. In this case, similar effects are obtained.

The present invention has been described with respect to an electrophotographic laser printer as an example of an image forming apparatus. However, the present invention may be applied to other image forming apparatuses such as a copying machine or a facsimile machine.

The above-described image forming apparatus includes a single developing device and forms single-color images. However, the image forming apparatus may include a plurality of developing devices and form multi-color images. In this case, image deterioration resulting from a mixture of color toner can be prevented while restraining the toner scattering and carrier falling.

Numerous additional modifications and variations of the present invention are possible in light of the above teachings. It is therefore to be understood that within the scope of the appended claims, the present invention may be practiced otherwise than as specifically described herein.

What is claimed is:

1. A developing device for developing a latent image formed on a latent image carrier with a developer, comprising:

a casing configured to accommodate the developer including toner and magnetic particles, the casing including an opening facing the latent image carrier;

a non-magnetic developer carrier configured to rotate and carry the developer to a developing region where the developer carrier faces the latent image carrier, and disposed such that a part of the developer carrier is exposed to the outside through the opening of the casing;

a magnetic field generating device disposed in the developer carrier to generate magnetic fields, the magnetic field generating device including a first magnetic pole generating a magnetic field that causes the developer to rise on the developer carrier in a form of a magnet brush in the developing region, and a second magnetic pole generating a magnetic field at a downstream side of the first magnetic pole in a direction of rotation of the developer carrier;

a toner-scattering restraining device provided on an end portion of the casing at a downstream side of the developing region in the direction of rotation of the developer carrier such that the toner-scattering restraining device faces the latent image carrier and reduces a gap between the developer carried on the developer carrier and the end portion of the casing, so as to restrain the toner from scattering from the gap; and a magnetic member provided on a side of the toner-scattering restraining device facing the latent image carrier, wherein a peak of a magnetic flux density set by the second magnetic pole in its normal direction is located at a position outside of the opening of the casing.

2. The developing device according to claim 1, wherein the toner-scattering restraining device includes a sheet-shaped member disposed substantially parallel to a normal direction connecting between the magnetic member and a rotation center of the developer carrier.

3. The developing device according to claim 1, wherein a side part of the magnetic member facing the latent image carrier has a polarity equal to a polarity of the second magnetic pole.

4. The developing device according to claim 1, wherein the toner in the developer is magnetic toner.

5. The developing device according to claim 1, wherein the second magnetic pole is an auxiliary magnetic pole that forms a magnetic force limiting a magnetic flux density distribution set up by the first magnetic pole in its normal direction.

6. An image forming apparatus, comprising:

a latent image carrier configured to carry a latent image;

a latent image forming device configured to form the latent image on the latent image carrier; and a developing device configured to develop the latent image formed on the latent image carrier with a developer including toner and magnetic particles to form a toner image, the developing device including, a casing configured to accommodate the developer, the casing including an opening facing the latent image carrier, a non-magnetic developer carrier configured to rotate and carry the developer to a developing region where the developer carrier faces the latent image carrier, and disposed such that a part of the developer carrier is exposed to the outside through the opening of the casing, a magnetic field generating device disposed in the developer carrier to generate magnetic fields, the magnetic field generating device including a first magnetic pole generating a magnetic field that causes the developer to rise on the developer carrier in a form of a magnet brush in the developing region, and a second magnetic pole generating a magnetic field at a downstream side of the first magnetic pole in a direction of rotation of the developer carrier, a toner-scattering restraining device provided on an end portion of the casing at a downstream side of the developing region in the direction of rotation of the developer carrier such that the toner-scattering restraining device faces the latent image carrier and reduces a gap between the developer carried on the developer carrier and the end portion of the casing, so as to restrain the toner from scattering from the gap, and a magnetic member provided on a side of the toner-scattering restraining device facing the latent image carrier, wherein a peak of a magnetic flux density set by the second magnetic pole in its normal direction is located at a position outside of the opening of the casing.

7. The image forming apparatus according to claim 6, wherein the toner-scattering restraining device includes a sheet-shaped member disposed substantially parallel to a normal direction connecting between the magnetic member and a rotation center of the developer carrier.

8. The image forming apparatus according to claim 6, wherein a side part of the magnetic member facing the latent image carrier has a polarity equal to a polarity of the second magnetic pole.

9. The image forming apparatus according to claim 6, wherein the toner in the developer is magnetic toner.

10. The image forming apparatus according to claim 6, wherein the second magnetic pole is an auxiliary magnetic pole that forms a magnetic force limiting a magnetic flux density distribution set up by the first magnetic pole in its normal direction.

11. An image forming apparatus, comprising:

latent image carrying means for carrying a latent image;

forming means for forming the latent image on the latent image carrying means; and developing means for developing the latent image formed on the latent image carrying means with a developer including toner and magnetic particles, the developing means including, accommodating means for accommodating the developer, the accommodating means including an opening facing the latent image carrying means, rotating and carrying means for rotating and carrying the developer to a developing region where the rotating and carrying means faces the latent image carrying means, the rotating and carrying means being formed from a non-magnetic material and disposed such that a part of the rotating and carrying means is exposed to the outside through the opening of the accommodating means, generating means for generating magnetic fields, the generating means being disposed in the rotating and carrying means and including a first magnetic pole generating a magnetic field that causes the developer to rise on the rotating and carrying means in a form of a magnet brush in the developing region, and a second magnetic pole generating a magnetic field at a downstream side of the first magnetic pole in a direction of rotation of the rotating and carrying means, restraining means for restraining the toner from scattering, the restraining means being provided on an end portion of the accommodating means at a downstream side of the developing region in the direction of rotation of the rotating and carrying means such that the restraining means faces the latent image carrying means and reduces a gap between the developer carried on the rotating and carrying means and the end portion of the accommodating means, so as to restrain the toner from scattering from the gap, and a magnetic member provided on a side of the restraining means facing the latent image carrying means, wherein a peak of a magnetic flux density set by the second magnetic pole in its normal direction is located at a position outside of the opening of the accommodating means.

12. The image forming apparatus according to claim 11, wherein the restraining means includes a sheet-shaped member disposed substantially parallel to a normal direction connecting between the magnetic member and a rotation center of the rotating and carrying means.

13. The image forming apparatus according to claim 11, wherein a side part of the magnetic member facing the latent image carrying means has a polarity equal to a polarity of the second magnetic pole.

14. The image forming apparatus according to claim 11, wherein the toner in the developer is magnetic toner.

15. The image forming apparatus according to claim 11, wherein the second magnetic pole is an auxiliary magnetic pole that forms a magnetic force limiting a magnetic flux density distribution set up by the first magnetic pole in its normal direction.

* * * * *